US011324252B2

(12) United States Patent
Besso et al.

(10) Patent No.: US 11,324,252 B2
(45) Date of Patent: May 10, 2022

(54) AEROSOL GENERATING ARTICLE HAVING CAVITY WITH PARTICULATE AEROSOL ALTERING MATERIAL

(71) Applicant: PHILIP MORRIS PRODUCTS S.A., Neuchatel (CH)

(72) Inventors: Clement Besso, Neuchatel (CH); Alen Kadiric, Orpund (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/753,438

(22) PCT Filed: Oct. 11, 2018

(86) PCT No.: PCT/EP2018/077723
§ 371 (c)(1),
(2) Date: Apr. 3, 2020

(87) PCT Pub. No.: WO2019/072962
PCT Pub. Date: Apr. 18, 2019

(65) Prior Publication Data

US 2020/0253276 A1 Aug. 13, 2020

(30) Foreign Application Priority Data

Oct. 13, 2017 (EP) ..... 17196485

(51) Int. Cl.
*A24F 13/00* (2006.01)
*A24F 17/00* (2006.01)
(Continued)

(52) U.S. Cl.
CPC ..... *A24D 3/048* (2013.01); *A24F 40/40* (2020.01)

(58) Field of Classification Search
CPC ..... A24F 40/40; A24D 3/048
See application file for complete search history.

(56) References Cited

U.S. PATENT DOCUMENTS 5,549,125 A * 8/1996 White ..... A24D 3/043 131/342
5,662,126 A * 9/1997 Charlton ..... A24D 1/02 131/342
(Continued)

FOREIGN PATENT DOCUMENTS

CN 101049187 10/2007
CN 101983018 3/2011
(Continued)

OTHER PUBLICATIONS

Extended European Search Report for Application No. 17196485.1 dated Jan. 30, 2018 (11 pages).
(Continued)

*Primary Examiner* — Abdullah A Riyami
*Assistant Examiner* — Thang H Nguyen
(74) *Attorney, Agent, or Firm* — Mueting Raasch Group

(57) ABSTRACT

An aerosol generating article (10) comprises an aerosol generating substrate (12); a mouthpiece (14) comprising an element (20) defining a cavity having a longitudinal axis; and a particulate aerosol altering material (30) partially filling the cavity. The particulate aerosol altering material (30) is adhered to the cavity-defining segment (20) by means of a permanent adhesive provided over at least a portion of an inner surface of the cavity-defining segment (20) to define an aerosol passage (32) substantially concentric with the longitudinal axis of the cavity.

15 Claims, 1 Drawing Sheet

(51) Int. Cl.

| | |
|---|---|
| ***A24F 25/00*** | (2006.01) |
| ***A24D 3/04*** | (2006.01) |
| ***A24F 40/40*** | (2020.01) |

(56) References Cited

U.S. PATENT DOCUMENTS

| | | | | |
|---|---|---|---|---|
| 6,089,238 | A * | 7/2000 | Schneider | A24D 1/00 131/338 |
| 6,257,242 | B1 * | 7/2001 | Stavridis | A24D 3/08 131/331 |
| 7,669,604 | B2 * | 3/2010 | Crooks | A24D 3/163 131/344 |
| 7,856,990 | B2 * | 12/2010 | Crooks | A24D 3/061 131/344 |
| 8,066,011 | B2 * | 11/2011 | Clark | A24D 3/048 131/337 |
| 8,375,959 | B2 * | 2/2013 | Dittrich | A24D 3/12 131/364 |
| 8,739,802 | B2 * | 6/2014 | Fagg | A24D 1/002 131/361 |
| 8,752,556 | B2 * | 6/2014 | White | A24D 3/163 131/207 |
| 10,842,193 | B2 * | 11/2020 | Sahin | A24F 40/30 |
| 2002/0179808 | A1 * | 12/2002 | Salinas | E04G 13/021 249/48 |
| 2013/0276803 | A1 | 10/2013 | Saito et al. | |
| 2019/0082735 | A1 * | 3/2019 | Phillips | A24D 1/22 |

FOREIGN PATENT DOCUMENTS

| | | | | |
|---|---|---|---|---|
| EP | 0 579 410 | | 1/1994 | |
| EP | 0717936 | | 2/1995 | |
| EP | 0457561 | | 2/1996 | |
| EP | 0822670 | | 2/1998 | |
| EP | 3 120 717 | | 1/2017 | |
| EP | 2775868 | | 3/2017 | |
| EP | 2549896 | | 7/2019 | |
| ES | 1135130 | | 2/2014 | |
| JP | 3120717 | * | 1/2017 | A24D 1/02 |
| WO | WO 2007/104908 | | 9/2007 | |
| WO | WO 2008/043988 | | 4/2008 | |
| WO | WO 2008/074977 | | 6/2008 | |
| WO | WO 2009/022232 | | 2/2009 | |
| WO | WO 2011/000638 | | 1/2011 | |
| WO | WO 2011/117584 | | 9/2011 | |
| WO | WO-2016092283 | A1 * | 6/2016 | A24D 3/04 |

OTHER PUBLICATIONS

Active Patch™ Filter, Essentra.com; https://www.essentra.com/en/industries/tobacco/filter-range/historical-developments/a . . . . Retrieved Oct. 13, 2017, 4 pages.

International Search Report and Written Opinion for PCT/EP2018/077723 dated Dec. 6, 2018 (10 pages).

Office Action issued in China for Application No. 201880061068.7 dated Nov. 3, 2021 (21 pages). English translation included.

* cited by examiner

AEROSOL GENERATING ARTICLE HAVING CAVITY WITH PARTICULATE AEROSOL ALTERING MATERIAL

This application is a U.S. National Stage Application of International Application No. PCT/EP2018/077723 filed Oct. 11, 2018, which was published in English on Apr. 18, 2019 as International Publication No. WO 201/072962 A1 International Application No. PCT/EP2018/077723 claims priority to European Application No. 17196485.1 filed Oct. 13, 2017.

The present invention relates to an aerosol generating article comprising a mouthpiece comprising an aerosol-altering particulate material.

It is well known to incorporate into aerosol generating articles materials capable of altering the chemical composition or sensory characteristics of the aerosol. By way of example, it is known to incorporate certain adsorbent materials into a filter element of an aerosol generating article, such as activated carbon or charcoal materials, in particulate or granular form. Also well-known is the incorporation of flavouring materials into a filter element of an aerosol generating article, such as in the form of a liquid flavourant encapsulated in a breakable shell.

In some aerosol generating articles, a multi-segment filter is provided wherein a cavity is defined between an upstream segment and a downstream segment, and a plurality of particles of an aerosol altering material is provided in the cavity. In general, it is desirable to achieve a percent fill of the cavities as close as possible to 100, with a 85 percent fill being a typical production target. By way of example, EP 0717936 discloses a multi-component filter comprising a flowable active material arranged in a cavity, wherein the flowable active material fills at least 95 percent of the volume of the cavity.

The manufacture of these aerosol generating articles requires repetitive supply of precisely metered amounts of particulate matter at a predetermined location along the production-line procession of the articles. However, achieving consistent and accurate filling of the cavities with particulate material can be difficult, particularly when operating at high speed. Further, depending on the size distribution of the particulate material, high percent fills may be associated with an undesirable increase in the resistance to draw (RTD) of the aerosol generating article.

Thus, it would be desirable to provide an aerosol generating article comprising an aerosol-altering material adapted to impart desirable properties to the aerosol whilst at the same time maintaining the RTD value of the aerosol generating article within a range acceptable for the consumer. Further, it would be desirable to provide one such aerosol generating article that is easy to manufacture without requiring an major modification of the existing apparatus.

According to an aspect of the present invention, there is provided an aerosol generating article comprising an aerosol generating substrate, a mouthpiece comprising an element defining a cavity having a longitudinal axis; and a particulate aerosol altering material partially filling the cavity. The particulate aerosol altering material is adhered to the cavity-defining segment by means of a permanent adhesive provided over at least a portion of an inner surface of the cavity-defining segment to define an aerosol passage substantially concentric with the longitudinal axis of the cavity.

According to a further aspect of the present invention, there is provided a mouthpiece for an aerosol generating article comprising a segment defining a cavity having a longitudinal axis and a particulate aerosol altering material partially filling the cavity. The particulate aerosol altering material is adhered to the cavity-defining segment by means of a permanent adhesive provided over at least a portion of an inner surface of the cavity-defining segment to define an aerosol passage substantially concentric with the longitudinal axis of the cavity.

It will be appreciated that any features described with reference to one aspect of the present invention are equally applicable to any other aspect of the invention.

The term "aerosol generating article" is used herein to denote both articles wherein an aerosol generating substrate is heated and articles wherein an aerosol generating substrate is combusted, such as conventional cigarettes. As used herein, the term "aerosol generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. In heated aerosol generating articles, an aerosol is generated by heating a flavour generating substrate, such as tobacco. Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention find particular application in aerosol generating systems comprising an electrically heated aerosol generating device having an internal heater blade which is adapted to be inserted into the rod of aerosol generating substrate. Aerosol generating articles of this type are described in the prior art, for example, in EP 0822670. As used herein, the term "aerosol generating device" refers to a device comprising a heater element that interacts with the aerosol generating substrate of the aerosol generating article to generate an aerosol. Aerosol generating article according to the invention may comprise a combustible carbon heat source for heating the aerosol generating substrate during use. Aerosol generating articles of this type are described in the prior art, for example, in WO 2009/022232. Also known are aerosol generating articles in which a nicotine-containing aerosol is generated from a tobacco material, tobacco extract, or other nicotine source, without combustion, and in some cases without heating, for example through a chemical reaction. During smoking, volatile compounds are released from the aerosol forming substrate by heat transfer from the fuel element and entrained in air drawn through the aerosol generating article. As the released compounds cool they condense to form an aerosol that is inhaled by the consumer.

As used herein, the terms "upstream" and "downstream" are used to describe the relative positions of features of an aerosol generating articles according to the invention in relation to the direction of aerosol or air drawn from the aerosol generating substrate through the mouthpiece during use. For example, in a mouthpiece where the cavity is upstream of a mouth end segment, aerosol is drawn first through the cavity and then through the mouth end segment.

In the present specification, the term "longitudinal" refers to the longitudinal axis of the aerosol generating article, which typically also corresponds to the direction of travel of the aerosol when the consumer draws upon the mouthpiece of the aerosol generating article. The term "transverse" refers to a plane lying substantially perpendicular to the longitudinal direction. Directions identified by straight lines lying in one such plane will be substantially perpendicular to the longitudinal direction.

The term "inner surface" is used throughout the specification to refer to the surface of a component of the aerosol generating article that is facing towards the interior of the aerosol generating article, for example towards the cavity. The term "outer surface" is used throughout the specification to refer to the surface of a component of the aerosol generating article that is facing towards the exterior of the aerosol generating article. For example, a wrapper circumscribing the upstream filter segment and the downstream filter segment comprises an outer surface that is facing the exterior of the aerosol generating article, and an inner surface that is facing towards the cavity.

The term "substantially transparent" is used to describe a material which allows at least a significant proportion of incident light to pass through it, so that it is possible to see through the material. In some embodiments of the present invention, a substantially transparent portion of the hollow tube segment allows sufficient light to pass through such that the particulate aerosol altering material is visible through the hollow tube segment. The substantially transparent portion may be completely transparent. Alternatively, said portion of the hollow tube segment may have a lower level of transparency whilst still transmitting sufficient light that the particulate aerosol altering material is visible through the hollow tube segment.

As described above, the aerosol generating article of the present invention incorporates a mouthpiece comprising an element defining a cavity extending along the longitudinal axis of the article and being partially filled with a particulate aerosol altering material. In contrast to existing aerosol generating articles, the particulate aerosol altering material is adhered to the cavity-defining segment by means of a permanent adhesive which is provided over at least a portion of an inner surface of the cavity-defining segment. Thus, an aerosol passage is defined in the mouthpiece, the aerosol passage being substantially concentric with the longitudinal axis of the cavity. Accordingly, at least some of the particulate aerosol altering material is directly exposed to the aerosol flowing along the aerosol passage during use.

Because the particulate aerosol altering material is arranged in a peripheral portion of the filter along the cavity, while a core of the cavity-defining segment is substantially hollow, aerosol generating articles in accordance with the present invention favourably enable an improved control of RTD, such that undesirably high RTD values can be avoided at all times. Further, by arranging the particulate aerosol altering material over an internal surface of the cavity-defining segment and by adjusting the size of the particles, it is possible to provide a sufficiently large interface for mass exchange—that is, a sufficiently high specific surface area exposed to the flow of aerosol—such that mass transfer phenomena adapted to alter the properties of the aerosol are favoured.

In those embodiments where at least a section of a peripheral wall of the cavity-defining segment is transparent, the content of the cavity is at least partly visible for the consumer. In particular, because the particulate material is adhered to the peripheral wall of the cavity-defining segment, it may be particularly easy for the consumer to check for the presence of the particulate material along the full length of the visible section of the cavity. This may impart aerosol generating articles in accordance with the invention a distinctive look. At the same time, it may make it easy for the manufacturer to check that the desired distribution of the particulate aerosol altering material over the inner surface of the cavity-defining segment is achieved during manufacturing.

Aerosol generating articles in accordance with the invention may be easy to manufacture on existing equipment. Because the particulate material is adhered to the cavity-defining segment, it may be easy to achieve a desired fill percent of the cavity in consistent and reliable fashion.

Aerosol generating articles in accordance with the present invention comprise an aerosol generating substrate. Preferably, the aerosol generating substrate comprises plant material, preferably a plant material comprising an alkaloid.

Alkaloids are a class of naturally occurring nitrogen-containing organic compounds. Alkaloids are found mostly in plants, but are also found in bacteria, fungi and animals. Examples of alkaloids include, but are not limited to, caffeine, nicotine, theobromine, atropine and tubocurarine. A preferred alkaloid is nicotine, which may be found in tobacco.

More preferably, the aerosol generating substrate comprises a plant material comprising nicotine, and even more preferably a tobacco-containing material.

As an alternative, or in addition, the aerosol generating substrate may comprise a botanical other than tobacco. As used herein, the term "botanical" includes anything derived from plants including, but not limited to, extracts, leaves, fibres, stems, roots, seeds, flowers, fruits, pollen, and the like. Preferably, the botanical is a botanical comprising an alkaloid.

In some embodiments, the aerosol generating substrate may be provided as a tobacco rod comprising tobacco material as a combustible, smokable material circumscribed by a wrapper. As used herein, the term 'rod' is used to denote a generally cylindrical element of substantially circular, oval or elliptical cross-section.

The tobacco material may typically comprise cured or processed tobacco, reconstituted tobacco, tobacco substitute materials, blends thereof, and blends thereof with pyrolysed or carbonised materials. The tobacco material may be employed in various manners, and is typically employed as a charge of strands. Optionally, the tobacco rod may additionally comprise material other than tobacco material, such as conventional additives such as humectants.

In other embodiments, the aerosol generating substrate may be provided as a rod comprising a gathered sheet of homogenised tobacco material circumscribed by a wrapper. As used herein, the term 'sheet' denotes a laminar element having a width and length substantially greater than the thickness thereof. As used herein, the term 'length' denotes the dimension in the direction of the cylindrical axis of rods according to the invention. As used herein, the term 'width' denotes a dimension in a direction substantially perpendicular to the cylindrical axis of rods according to the invention. As used herein, the term 'homogenised tobacco material' denotes a material formed by agglomerating particulate tobacco. As used herein, the term 'gathered' denotes that the sheet of homogenised tobacco material is convoluted, folded, or otherwise compressed or constricted substantially transversely to the cylindrical axis of the rod.

In some embodiments, the aerosol generating substrate may further comprise an aerosol former. As used herein, the term "aerosol former" describes any suitable known compound or mixture of compounds that, in use, facilitates formation of an aerosol and that is substantially resistant to thermal degradation at the operating temperature of the aerosol-generating article. Suitable aerosol-formers are known in the art and include, but are not limited to:

polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine.

The rod of aerosol generating substrate preferably has an external diameter that is approximately equal to the external diameter of the aerosol generating article.

Preferably, the rod of aerosol generating substrate has an external diameter of at least 5 millimetres. The rod of aerosol generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol generating substrate has an external diameter of 7.2 millimetres, to within 10 percent.

Preferably, the rod of aerosol generating substrate has a substantially uniform cross-section along the length of the rod. Particularly preferably, the rod of aerosol generating substrate has a substantially circular cross-section.

Further, aerosol generating articles in accordance with the invention comprise a mouthpiece comprising an element defining a cavity extending along the longitudinal axis of the aerosol generating article. The mouthpiece is in axial alignment with the aerosol generating substrate and may be in abutting end-to-end relationship with the aerosol generating substrate. In some embodiments the mouthpiece may be affixed to the aerosol generating substrate, such as for example by being circumscribed and joined to the aerosol generating substrate by tipping paper.

In some embodiments the mouthpiece comprises an upstream filter segment and a downstream filter segment in axial alignment with, and spaced from, the upstream filter segment, the cavity-defining segment extending between the upstream filter segment and the downstream filter segment. The upstream filter segment and the downstream filter segment comprise filtration material. Suitable filtration materials include, but are not limited to, cellulose acetate tow. Alternative filtration materials include crimped paper or other suitable filtration materials known in the manufacturing of cigarette filters.

In preferred embodiments, the cavity-defining element comprises a hollow tube segment arranged between the upstream filter segment and the downstream filter segment.

Preferably, the hollow tube segment comprises a substantially transparent portion, such that the particulate aerosol altering material is visible through the hollow tube segment. In particularly preferred embodiments, the hollow tube segment is entirely made from a substantially transparent material.

In alternative embodiments, the cavity-defining element comprises a first wrapper circumscribing and joining the upstream filter segment and the downstream filter segment. Preferably, the first wrapper preferably comprises a substantially transparent portion at a location along the cavity, such that the particulate aerosol altering material is visible through the first wrapper. In particularly preferred embodiments, the first wrapper is entirely formed from a substantially transparent material, such as for example cellophane. Other suitable substantially transparent materials include cellulose acetate film and polylactic acid (PLA) film.

A particulate aerosol altering material partially fills the cavity. In more detail, the particulate aerosol altering material is adhered to the cavity-defining segment by means of a permanent adhesive provided over at least a portion of an inner surface of the cavity-defining segment to define an aerosol passage substantially concentric with the longitudinal axis of the cavity. Accordingly, at least a portion of the particulate aerosol altering material is directly exposed to the aerosol flowing along the aerosol passage during use.

In those embodiments where the cavity-defining element comprises a hollow tube segment, the particulate aerosol altering material is adhered to a radially inner surface of the hollow tube segment. In those embodiments where the cavity-defining element comprises a first wrapper circumscribing the upstream filter segment and the downstream filter segment, the particulate aerosol altering material is adhered to a radially inner surface of the first wrapper.

In more detail, the particulate aerosol altering material is adhered to the radially inner surface of the hollow tube segment or to the radially inner surface of the first wrapper by means of an adhesive such that the particulate aerosol altering material is not entirely trapped by or embedded within the adhesive, but such that at least a portion of the surface area of the particulate aerosol altering material is directly exposed to the aerosol flowing along the aerosol passage during use.

Preferably, less than about 70 percent of an overall surface area of the particulate aerosol altering material is directly in contact with the adhesive material. More preferably, less than about 50 percent of an overall surface area of the particulate aerosol altering material is directly in contact with the adhesive material. Even more preferably, less than about 30 percent of an overall surface area of the particulate aerosol altering material is directly in contact with the adhesive material.

Preferably, at least about 25 percent of an overall surface area of the particulate aerosol altering material is directly exposed to the aerosol flowing along the aerosol passage during use. More preferably, at least about 35 percent of an overall surface area of the particulate aerosol altering material is directly exposed to the aerosol flowing along the aerosol passage during use. Even more preferably, at least about 50 percent of an overall surface area of the particulate aerosol altering material is directly exposed to the aerosol flowing along the aerosol passage during use.

More preferably, the aerosol generating article comprises a second wrapper circumscribing the mouthpiece, wherein the second wrapper overlies the first wrapper and comprises at least one cut-out portion exposing an area of the transparent portion of the first wrapper, such that an underlying portion of the cavity-defining segment of the mouthpiece incorporating the particulate aerosol altering material is visible. Thus, the second wrapper does not need to be formed of a transparent material and can therefore be formed of an alternative material that provides desirable textural and surface properties. Preferably, the second wrapper is opaque. In some preferred embodiments, the second wrapper is a tipping paper formed of a cellulosic paper sheet material, as in conventional cigarettes. In this way, the second wrapper may advantageously provide a familiar texture and mouth feel to the consumer.

The second wrapper is provided over the substantially transparent wrapper and is preferably glued or laminated onto the substantially transparent wrapper. The position and size of the cut-out portion are provided such that the cut-out portion overlies the transparent portion of the first wrapper. In addition, the position and size of the cut-out portion in the outer wrapper can advantageously be provided such that the substantially transparent wrapper exposed through the cut-out portion does not come into contact with the lips of the consumer during use of the aerosol generating article.

The at least one cut-out portion extends around less than the full circumference of the mouthpiece, such that the second wrapper can be conveniently formed of a single piece of sheet material which can be wrapped around the mouthpiece using standard apparatus and techniques. Thus, the second wrapper remains an integral second wrapper even once the cut-out portion has been removed from the outer wrapper.

The at least one cut-out portion may be of any suitable shape, including but not limited to a circle, oval, square, triangle, diamond or rectangle. A single cut-out portion may be provided in the second wrapper, or two or more cut-out portions may be provided which are spaced from each other in the longitudinal direction of the aerosol generating article, or the circumferential direction of the aerosol generating article, or both. This enables the consumer to view different parts or segments of the mouthpiece, which may or may not have the same appearance as each other. Where two or more cut-out portions are provided, the cut-out portions may be the same size and shape, or at least one of the size and shape may be different.

The provision of a cavity-defining element comprising at least a transparent section is advantageous in that, during manufacturing, it is easy to check that the desired amount of particulate aerosol altering material is adhered to the inner surface of the cavity-defining segment. In addition, this allows the consumer to verify that the particulate material is present along the full length of the visible section of the cavity. Thus, aerosol generating articles in accordance with the invention have a distinctive look that is easy to recognise for the consumer.

Preferably, the particulate aerosol altering material occupies less than 50 percent of the space in the cavity. More preferably, the particulate aerosol altering material occupies less than 40 percent of the space in the cavity. Even more preferably, the particulate aerosol altering material occupies less than 30 percent of the space in the cavity. This is advantageous in that the presence of the particulate aerosol altering material substantially does not impact the resistance to draw (RTD) of the segment cavity-defining segment of the mouthpiece. In more detail, the RTD of the segment cavity-defining segment of the mouthpiece remains substantially negligible or null.

In addition, or as an alternative, the particulate aerosol altering material preferably occupies at least 5 percent of the space in the cavity. More preferably, the particulate aerosol altering material occupies at least 10 percent of the space in the cavity. Even more preferably, the particulate aerosol altering material occupies at least 15 percent of the space in the cavity.

Preferably, the RTD of the aerosol generating article is between about 35 mm WG and about 140 mm WG, more preferably between about 40 mm WG and about 120 mm WG. As used herein, resistance to draw is expressed with the units of pressure 'mm WG' or 'mm of water gauge' and is measured in accordance with ISO 6565:2002.

In some embodiments, the RTD of the aerosol generating article is preferably from about 35 mm WG to about 50 mm WG. In other embodiments, the RTD of the aerosol generating article is preferably from about 60 mm WG to about 80 mm WG.

In alternative embodiments, the RTD of the aerosol generating article is preferably from about 70 mm WG to about 140 mm WG, more preferably from about 80 mm WG to about 120 mm WG.

In preferred embodiments, the particulate aerosol altering material is adhered to the cavity-defining segment by means of a permanent adhesive provided over substantially the whole surface area of the inner surface of the cavity-defining segment. This is advantageous in that it maximises the content of particulate aerosol altering material in the mouthpiece and favours a more prolonged contact of the aerosol flowing through the mouthpiece with the particulate aerosol altering material, which should in turn favour the mass transfer phenomena underlying the interaction of the aerosol with the particulate material. By way of example, where the particulate aerosol altering material is a flavourant, this may favour the transfer of flavouring species into the flow of aerosol. Where the particulate aerosol altering material is an absorbent material, this may favour the transfer of certain species from the flow of aerosol to the absorbent material.

In some embodiments, the particulate aerosol altering material includes at least one flavourant material that is capable of releasing flavour into the aerosol generated by the aerosol generating article during use. Preferably, the particulate flavourant material comprises plant material. More preferably, the plant material is provided in the form of granules.

In certain preferred embodiments, the particulate flavourant material may include particles of a sorbent or cellulosic material impregnated with a liquid flavourant. In some preferred embodiments, the particulate flavourant material may comprise particles of plant leaf, such as leaf from tobacco, green tea, peppermint, spearmint, laurel, eucalyptus, basil, sage, verbena and tarragon. In addition, portions of mint plants may also be used. The term 'mint' refers to plants that belong to the genus Mentha. The plant material may alternatively be in the form of a seed, root, bark or flower, such as those typically used as spices.

If desired, the particulate flavourant material may be coloured, for example through the addition of a suitable dye or pigment. For example, the particulate flavourant material may be of a colour that is commonly associated with the flavour provided by the material, such as a green colour for a mint flavour.

In other embodiments, the particulate aerosol altering material includes a particulate material that does not comprise a flavourant, such as beads or granules of a cellulosic material or a sorbent capable of removing at least one constituent, such as for example a gas phase constituent, from the aerosol drawn through the mouthpiece. A suitable sorbent can be selected from the group consisting of activated carbon, carbon beads, active aluminium, zeolites, sepiolites, molecular sieves and silica gel. In other embodiments, the particulate aerosol altering material may include a catalyst.

Preferably, the particulate aerosol altering material has a mean average particle size of less than about 1000 micrometres.

In addition, or as an alternative, the particulate aerosol altering material has a mean average particle size of at least about 150 micrometres.

In embodiments where the particulate aerosol altering material is a sorbent, values of average particle size in the ranges described above are typically advantageously associated with desirably high values of specific surface area.

In embodiments where the particulate aerosol altering material is a sorbent, the particulate aerosol altering material preferably has a specific surface area of at least about 300 square metres per gram, more preferably at least about 500 square metres per gram, even more preferably at least about 700 square metres per gram.

By way of example, one suitable particulate aerosol material may comprise activated carbon provided in the form of fine granules having an average particle size from about 200 micrometres to about 850 micrometres, a specific surface area (BET, nitrogen) of about 1200 square metres per gram. Another example of a suitable particulate aerosol altering material may comprise granular silica gel having an average particle size from about 500 micrometres to about 1000 micrometres and a specific surface area (BET, nitrogen) of about 400 square metres per gram.

Aerosol generating articles in accordance with the invention may be manufactured on existing equipment. Only minor modifications to existing processes may be required for providing the particulate material partially filling the internal volume of the cavity-defining segment.

In some embodiments, methods of manufacturing an aerosol generating article in accordance with the present invention comprise: providing a hollow tube segment, an inner surface of the hollow tube segment being coated with a permanent adhesive; at least partially filling the cavity defined by the hollow tube segment with aerosol-altering particulate material, such that aerosol-altering material adheres to the inner surface of the hollow tube segment; removing from the cavity defined by the hollow tube segment aerosol-altering material not adhered to the inner surface of the hollow tube segment.

By way of example, in one such method a plurality of hollow tube segments is positioned on a flat surface, for example on a tray, the tube segments being arranged with their longitudinal axes perpendicular to the flat surface. Thus, the hollow tube segments are open at their top ends and adapted to receive aerosol particulate material through the open top ends. By filling the tray with particulate material, the cavities defined by the hollow tube segments are also substantially filled. However, only the particulate material at the periphery of the cavity adheres to the inner surface of the tube segments, which is coated with the permanent adhesive. By briefly shaking the tray, the excess particulate material can conveniently be removed and directed to a collection vessel, so that it can be recycled into the manufacturing process.

By adjusting the size of the particulate material and the percentage of the surface area of the inner surface of the cavity-defining segment coated with the permanent adhesive, the amount of particulate material adhered to the cavity-defining segment can conveniently be adjusted. Thus, it is easy to achieve a desired fill percent of the cavity consistently and reliably.

The invention will now be further described with reference to the figures in which.

Figure 1:
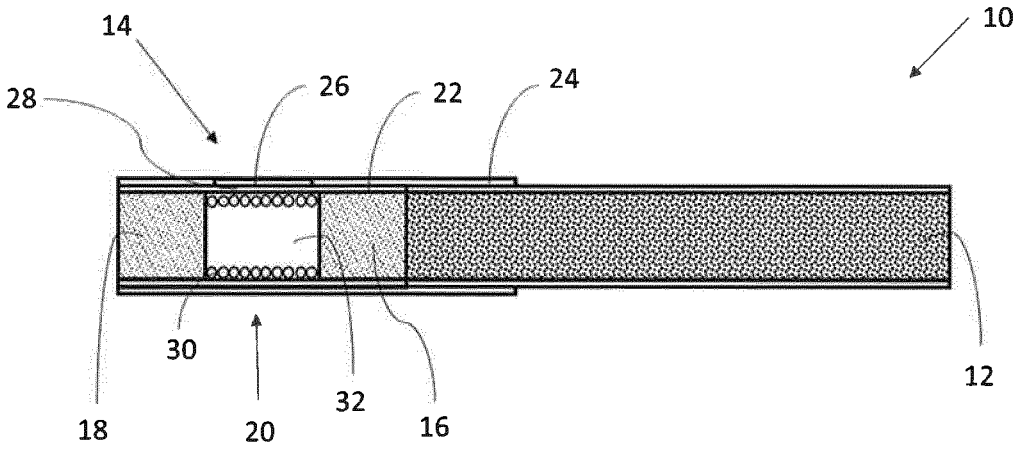
FIG. 1 shows a schematic side sectional view of an embodiment of an aerosol generating article in accordance with the present invention.

The aerosol generating article 10 shown in FIG. 1 comprises a rod of aerosol generating substrate 12 and a mouthpiece 14. The mouthpiece 14 comprises a first upstream filter segment 16 and a downstream filter segment 18 in axial alignment with, and spaced from, the upstream filter segment 16. Further, the mouthpiece 14 comprises a cavity-defining segment 20 extending between the upstream filter segment 16 and the downstream filter segment 18.

In the embodiment of FIG. 1 the cavity-defining segment 20 comprises a first wrapper 22 circumscribing the upstream filter segment 16 and the downstream filter segment 18. The first wrapper 22 is substantially transparent.

A second wrapper 24 circumscribes the mouthpiece 14. In more detail, the second wrapper 24 overlies the first wrapper 22 and comprises a cut-out portion 26 which exposes an area 28 of the underlying substantially transparent first wrapper 22.

In addition, the mouthpiece comprises a particulate aerosol altering material 30 partially filling the cavity. The particulate aerosol altering material 30 is adhered to the cavity-defining segment 20 by means of a permanent adhesive provided over substantially the whole surface area of the inner surface of the cavity-defining segment 20. The particulate aerosol altering material comprises a flavourant and occupies about 20 percent of the space in the cavity. Thus, an aerosol passage 32 substantially concentric with the longitudinal axis of the cavity is defined in the aerosol generating article 10.

Figure 2:
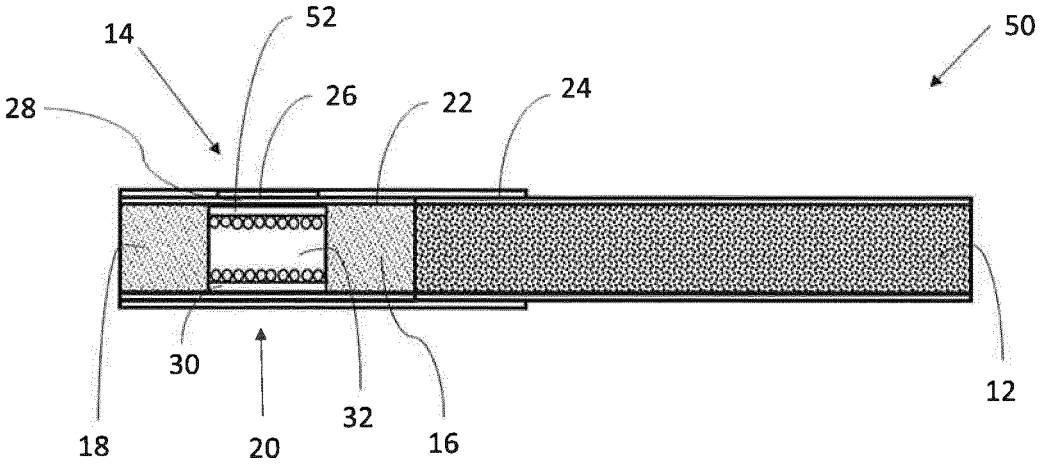
FIG. 2 shows a schematic side sectional view of a further embodiment of an aerosol generating article in accordance with the invention.

FIG. 2 illustrates another smoking article 50 in accordance with the invention. The smoking article 50 is similar to the smoking article 10 of FIG. 1 and is described below only insofar as it differs from it, and using the same reference numbers, where possible, for identical or corresponding parts of smoking articles 50 and 10.

In the embodiment of FIG. 2 the cavity-defining segment 20 comprises a substantially transparent hollow tube segment 52. A substantially transparent first wrapper 22 circumscribes the upstream filter segment 16, the downstream filter segment 18, and the hollow tube segment 52. The particulate aerosol altering material 30 is adhered to the radially inner surface of the hollow tube segment 52. To this purpose substantially the whole radially inner surface of the hollow tube segment 52 is coated with a permanent adhesive.

The invention claimed is:

1. An aerosol generating article comprising:

an aerosol generating substrate;

a mouthpiece comprising an element defining a cavity having a longitudinal axis; and a particulate aerosol altering material partially filling the cavity, wherein the particulate aerosol altering material is adhered to the cavity-defining segment by a permanent adhesive provided over at least a portion of an inner surface of the cavity-defining segment to define an aerosol passage substantially concentric with the longitudinal axis of the cavity, at least a portion of a surface area of the particulate aerosol altering material being directly exposed to aerosol flowing along the aerosol passage during use, wherein less than about 70 percent of an overall surface area of the particulate aerosol altering material is directly in contact with the permanent adhesive.

2. The aerosol generating article in accordance with claim 1, wherein the mouthpiece comprises an upstream filter segment and a downstream filter segment in axial alignment with, and spaced from, the upstream filter segment, the cavity-defining segment extending between the upstream filter segment and the downstream filter segment.

3. The aerosol generating article in accordance with claim 2, wherein the cavity-defining element comprises a hollow tube segment, the particulate aerosol altering material being adhered to a radially inner surface of the hollow tube segment.

4. The aerosol generating article in accordance with claim 3, wherein the hollow tube segment comprises a substantially transparent portion, such that the particulate aerosol altering material is visible through the hollow tube segment.

5. The aerosol generating article in accordance with claim 2, wherein the cavity-defining element comprises a first wrapper circumscribing the upstream filter segment and the downstream filter segment, the particulate aerosol altering material being adhered to a radially inner surface of the first wrapper.

6. The aerosol generating article in accordance with claim 5, wherein the first wrapper comprises a substantially transparent portion at a location along the cavity, such that the particulate aerosol altering material is visible through the first wrapper.

7. The aerosol generating article in accordance with claim 6 comprising a second wrapper circumscribing the mouthpiece, wherein the second wrapper overlies the first wrapper and comprises at least one cut-out portion exposing an area of the transparent portion of the first wrapper, such that an underlying portion of the cavity-defining segment of the mouthpiece incorporating the particulate aerosol altering material is visible.

8. The aerosol generating article in accordance with claim 1 wherein the particulate aerosol altering material occupies less than 50 percent of the space in the cavity.

9. The aerosol generating article in accordance with claim 1 wherein the particulate aerosol altering material occupies less than 40 percent of the space in the cavity.

10. The aerosol generating article in accordance with claim 1 wherein the particulate aerosol altering material is adhered to the cavity-defining segment by the permanent adhesive provided over substantially the whole surface area of the inner surface of the cavity-defining segment.

11. The aerosol generating article in accordance with claim 1 wherein the particulate aerosol altering material comprises a sorbent or a catalyst.

12. The aerosol generating article in accordance with claim 1 wherein the particulate aerosol altering material comprises a flavourant.

13. The aerosol generating article in accordance with a claim 1 wherein the particulate aerosol altering material has a mean average particle size of less than about 1000 micrometres.

14. The aerosol generating article in accordance with claim 13, wherein the particulate aerosol altering material has a mean average particle size of at least about 150 millimetres.

15. An A mouthpiece for an aerosol generating article comprising a segment defining a cavity having a longitudinal axis and a particulate aerosol altering material partially filling the cavity, wherein the particulate aerosol altering material is adhered to the cavity-defining segment by a permanent adhesive provided over at least a portion of an inner surface of the cavity-defining segment to define an aerosol passage substantially concentric with the longitudinal axis of the cavity, at least a portion of a surface area of the particulate aerosol altering material being directly exposed to aerosol flowing along the aerosol passage during use.

* * * * *